US006726387B2

(12) United States Patent
Dumler et al.

(10) Patent No.: US 6,726,387 B2
(45) Date of Patent: Apr. 27, 2004

(54) HAIR DYEING OR COSMETIC UNIT

(75) Inventors: Norbert Dumler, Ansbach (DE); Werner Fischer, Burk (DE)

(73) Assignee: Geka Brush GmbH, Bechhofen (DE)

( * ) Notice: Subject to any disclaimer, the term of this patent is extended or adjusted under 35 U.S.C. 154(b) by 0 days.

(21) Appl. No.: 10/396,827

(22) Filed: Mar. 26, 2003

(65) Prior Publication Data

US 2003/0185617 A1 Oct. 2, 2003

(30) Foreign Application Priority Data

Mar. 26, 2002 (DE) ..... 102 13 365

(51) Int. Cl.[7] ..... A46B 11/00; B43K 5/12

(52) U.S. Cl. ..... 401/124; 401/123; 401/192; 401/125

(58) Field of Search ..... 401/123, 124, 401/125, 126, 129, 192, 18, 128, 130; 132/317, 218, 216

(56) References Cited

U.S. PATENT DOCUMENTS 2,141,327 A * 12/1938 Younghusband ..... 401/18
4,447,169 A * 5/1984 Vartoughian ..... 401/269
5,158,383 A * 10/1992 Glover et al. ..... 401/150
6,158,913 A 12/2000 Dumler et al.
6,343,887 B1 2/2002 Dumler et al.

FOREIGN PATENT DOCUMENTS

| | | |
|---|---|---|
| DE | 1 011 599 | 11/1959 |
| DE | 44 05 335 | 8/1995 |
| DE | 197 44 181 | 4/1999 |
| DE | 198 48 471 | 4/2000 |
| DE | 100 39 490 | 2/2002 |
| EP | 0 955 368 | 11/1999 |
| EP | 0 681 795 | 11/2001 |

* cited by examiner

*Primary Examiner*—David J. Walczak
(74) *Attorney, Agent, or Firm*—Browdy & Neimark, P.L.L.C.

(57) ABSTRACT

In a hair dyeing or cosmetic unit, in particular a mascara unit, comprising a reservoir for holding the liquid cosmetic and a cap as well as an applicator that is mounted on a handle, it is provided, with a view to facilitation of purchase, that the cosmetic unit is designed such that, when presented for purchase, the applicator does not dip into the liquid cosmetic and is visible through a transparent section of a member of the cosmetic unit.

5 Claims, 3 Drawing Sheets

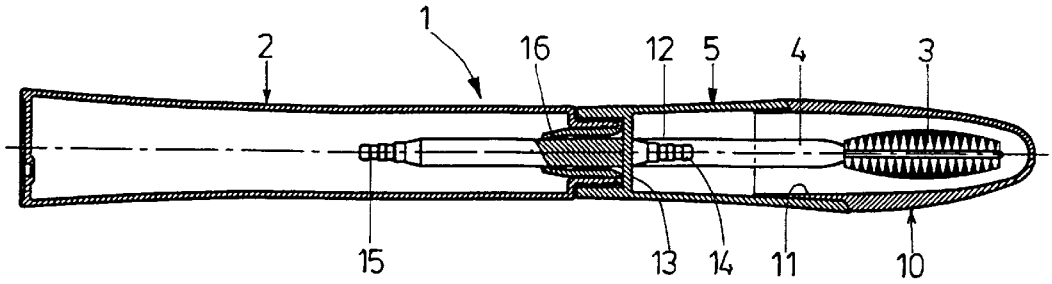
FIG. 1
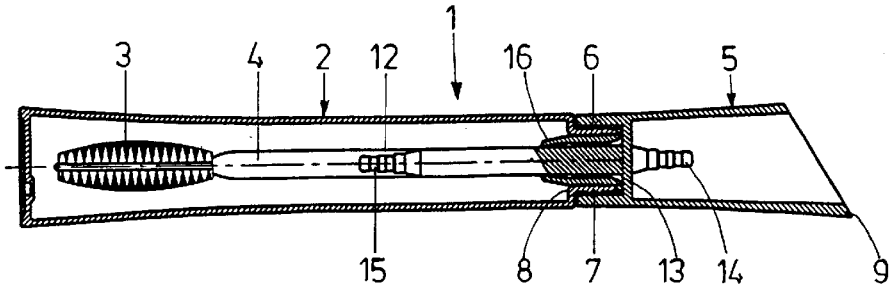
FIG. 2
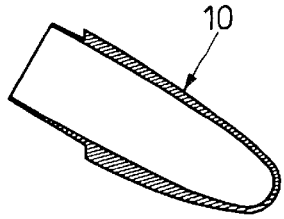

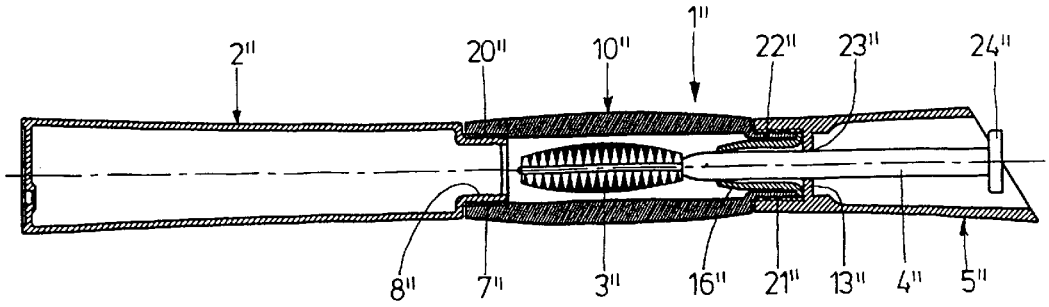
FIG. 4
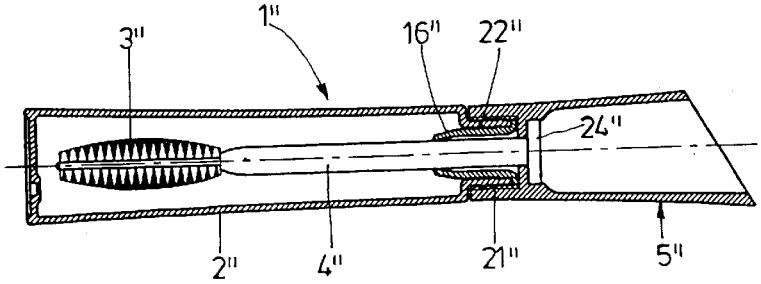
FIG.5
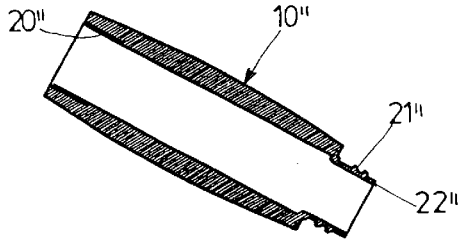

HAIR DYEING OR COSMETIC UNIT

BACKGROUND OF THE INVENTION

1. Field of the Invention

The invention relates to a hair dyeing or cosmetic unit, in particular mascara unit, comprising a reservoir for holding a liquid cosmetic and a cap as well as an applicator that is fixed to a handle.

2. Background Art

Numerous designs of hair dyeing or cosmetic units of the generic type, in particular mascara units, have been disclosed, for instance in U.S. patent application Ser. No. 08/391,703, DE 197 44 181 A1 and U.S. Pat. No. 6,158,913.

These familiar units are usually provided with brushes as applicators, lots of modifications of these brushes being known for optimization of mascara transfer properties upon transfer from the container on to a user's lashes and of combing properties during application. However, a fundamental drawback of these hair dyeing or cosmetic units resides in that the user will regularly acquire a specific mascara brush along with her/his favorite manufacturer's mascara, it being possible to choose from a variety of cosmetic units with different brushes, but not to select the brush or applicator individually for a certain mascara.

In the light of these problems, EP 0 955 368 teaches that a user, having selected a preferred applicator or handle from a variety thereof, may join the applicator to the handle or the handle to the cap. This offers numerous advantages as compared to prior art units.

However, there are marketing concepts proceeding from the idea that a certain brush must be specifically tuned to the type and consistency of the cosmetic to be applied and that the composition of applicator and cosmetic must not be disrupted.

SUMMARY OF THE INVENTION

It is an object of the invention to embody a cosmetic unit of the type mentioned at the outset for defined allocation of an applicator brush, in particular mascara brush, to a cosmetic compound on the one hand; on the other hand, the specific properties of the applicator must be apparent and perceptible to the consumer upon purchase.

According to the invention, this object is attained in a cosmetic unit of a design such that, when presented for purchase, the applicator does not dip into the liquid cosmetic and can be seen through a transparent section of the cosmetic unit.

Preferably, the transparent section is a separate member which is releasably joined to the reservoir and/or to the cap of the reservoir.

By advantage, the design is such that after removal of the member that comprises the transparent section when the cosmetic unit is put to use by a consumer, the cap is attachable to the reservoir in a manner known per se.

In keeping with a first embodiment according to the invention, it is provided that, prior to use by a consumer, the applicator extends in a direction away from the reservoir and is covered by the member which comprises the transparent section and which is joined to the screw cap.

In particular, it can be provided that, in the initial condition, the applicator handle is releasably joined to a fixture on the screw cap and, for use, is mountable on a stem, in particular by locking engagement, the stem extending from the screw cap in the opposite direction into the reservoir.

In keeping with a second embodiment according to the invention, the applicator initially extends away from the container; it is disposed on the top of the screw cap and provided with a transparent cover.

When the unit is put to use, the transparent cover is removed and the screw cap is rotated by 180° and conventionally screwed on, with the handle and the applicator dipping into the liquid cosmetic.

In this case, the container, prior to being put to use, may be covered by a separate cap, on which to place the top or rear of the screw cap.

In keeping with a third embodiment, the applicator conventionally extends from the screw cap towards the reservoir, with, however, the member that includes the transparent section being disposed between the screw cap and the reservoir so that, in this condition, the applicator does not dip into the cosmetic or the reservoir. In this condition, the reservoir is closed by a temporary closure, for instance a peel-off film, a plug or the like; for putting the unit to use, the cap is screwed off the intermediate member, the intermediate member is screwed off the reservoir and removed, the temporary closure of the reservoir is removed and the screw cap, together with the applicator, is screwed on conventionally, with the applicator dipping into the reservoir.

Details of the invention will become apparent from the ensuing description of an exemplary embodiment, taken in conjunction with the drawing:

BRIEF DESCRIPTION OF THE DRAWING

FIG. 1 is a longitudinal sectional view of a ready-for-sale mascara unit according to the invention;

FIG. 2 is an illustration, corresponding to FIG. 1, of the unit when in use;

FIG. 4 is a longitudinal sectional view of a third embodiment of a ready-for-sale mascara unit; and FIG. 5 is a corresponding illustration of the unit when in use.

DESCRIPTION OF THE PREFERRED EMBODIMENT

Figure 3:
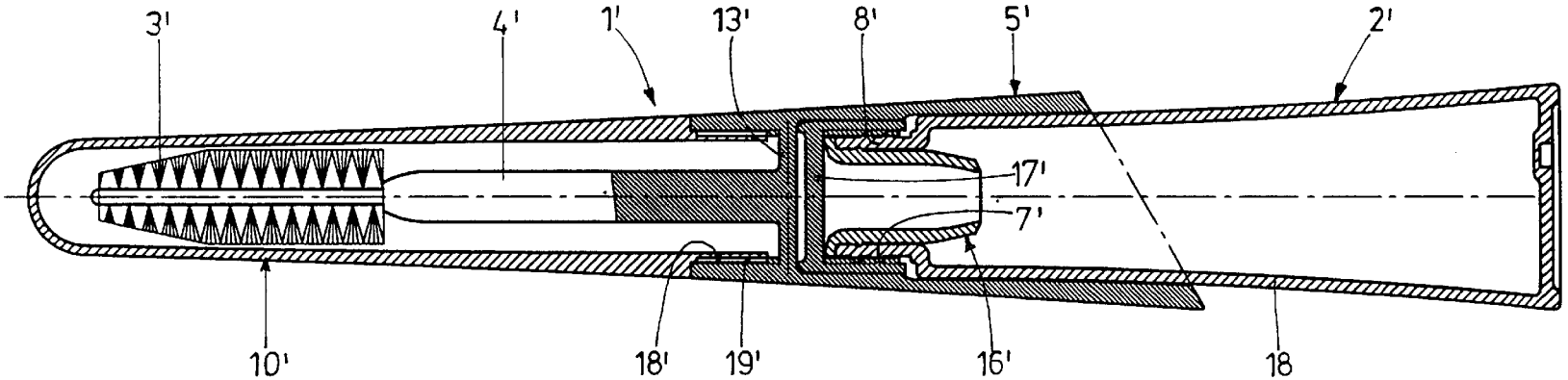
FIG. 3 is a longitudinal sectional view of a second embodiment of a ready-for-sale mascara unit.

A mascara unit 1 seen in FIGS. 1 and 2 comprises a reservoir 2 for mascara, an applicator 3 in the form of a brush and a handle 4 as well as a screw cap 5, a thread 6 of which can be screwed on the external thread 7 of the neck 8 of the reservoir 2 in a manner known per se.

In the condition seen in FIG. 1, upon shipment of the mascara unit or upon purchase by a user, a transparent plastic member 10 is screwed on the top edge 9 of the screw cap onto a section 11 of reduced wall thickness for the mascara brush 3 and its design to be visible through the transparent wall.

The end 12 of the handle 4 of the mascara brush 3 is placed on a plug-in attachment 14 that is formed on the bottom 13 of the screw cap 5.

For putting the mascara unit 1 to use, as illustrated in FIG. 2, the transparent member 10 is removed, the handle 4, including the mascara brush 3, is detached from the attachment 14 and placed on a corresponding stem 15 which extends from the other side of the screw-cap-5 bottom 13 inwards into the reservoir 2. A wiper 16 is provided in the vicinity of the neck 8 in a manner known per se so that customary use of the mascara unit 1 is possible in the condition seen in FIG. 2.

The embodiment seen in FIG. 3 again provides a reservoir 2' with a neck 8' and an external thread 7' as well as a wiper 16' disposed in the vicinity thereof. In the condition of shipment or purchase seen in FIG. 3, a separate closure cap 17' is screwed on the external thread 7'. The screw cap 5' for subsequent use is placed on this cap 17', enfolding it and the external wall 18 of the reservoir 2'.

A handle 4' with a mascara brush 3' extends from the bottom 13' of the screw cap 5' in a direction away from the reservoir 2'. Covering the mascara brush 3' is a transparent cap 10', an external thread 18' of which is screwed on an internal thread 19' of the screw cap 5'.

When the unit is put to use, the cap or transparent member 10' is screwed off and the screw cap 5' is detached, the cap 17' is screwed off, and the screw cap 5', including the handle 4' and the mascara brush 3', is rotated by 180°, inserted through the wiper 16' into the reservoir 2' and its internal thread 19' is screwed on the external thread 7' of the reservoir 2' so that conventional use of the mascara unit 1' is again possible.

The embodiment seen in FIGS. 4 and 5 again provides a reservoir 2" with a tapered neck 8" and an external thread 7" as well as a screw cap 5" including a mascara brush 3" and a handle 4".

In the condition seen in FIG. 4, a transparent member 10" is screwed by an internal thread 20" on the external thread 7" of the reservoir 2", while the screw cap 5" is screwed on an external thread 21" of the tapered neck 22" at the opposite end of the transparent member 10". A wiper 16" is inserted in the neck 22". The handle 4" of the mascara brush 3" passes through a recess 23" in the bottom 13" of the screw cap 5", its end on the extreme right in the drawing being provided with a stop 24".

Upon purchase, a user may have a close look through the transparent member 10" at the design of the mascara brush 3", after which, for the unit to be put to use i.e. for it to be transferred into the condition seen in FIG. 5, the transparent member 10" is screwed off the reservoir 2" and the screw cap 5" is screwed off the transparent member 10". Then the screw cap 5" and the wiper 16", which is still on the screw cap 5", are screwed on the reservoir 2" and, when the stop 24" is pressed, the handle 4" is pushed to the left in the drawing right into the reservoir so that conventional use of the mascara unit 1" seen in FIG. 5 will be possible.

What is claimed is:

1. A hair dyeing or cosmetic unit, in particular mascara unit, comprising a reservoir for holding a liquid cosmetic and a screw cap as well as an applicator mounted on a handle, wherein the cosmetic unit (1, 1', 1") is designed such that, upon purchase, the applicator (3, 3', 3") does not dip into the liquid cosmetic and is visible through a transparent member (10, 10', 10") of the cosmetic unit (1, 1', 1"), wherein, in the initial condition, the handle (4) of the applicator (3) is releasably joined to a fixture of the screw cap (5) and, for use, is mountable on a stem (15), in particular by locking engagement, the stem (15) extending from the screw cap (5) into the reservoir (2).

2. A hair dyeing or cosmetic unit according to claim 1, wherein the transparent member (10, 10', 10") is releasably joined to the, screw cap (5, 5', 5") of the reservoir (2, 2', 2").

3. A hair dyeing or cosmetic unit according to claim 2, wherein, after removal of the transparent member (10, 10', 10") when the cosmetic unit (1, 1', 1") is put to use by a consumer, the screw cap (5, 5', 5") is attachable to the reservoir (2, 2', 2") in a manner known per se.

4. A hair dyeing or cosmetic unit according to claim 1, wherein, prior to use by the consumer, the applicator (1) extends in a direction away from the reservoir (2) and is covered by the transparent member (10), wherein the member (10) is joined to the screw cap (5).

5. A hair dyeing or cosmetic unit according to claim 1, wherein the applicator (3') initially extends away from the reservoir (2') and is disposed on the top surface of the screw cap (5') and provided with the transparent member (10') in the form of a cover.

* * * * *